United States Patent [19]

Olson et al.

[11] Patent Number: 4,957,456

[45] Date of Patent: Sep. 18, 1990

[54] SELF-ALIGNING RF PUSH-ON CONNECTOR

[75] Inventors: Mark Olson, Torrance; Clifton Quan, Arcadia, both of Calif.

[73] Assignee: Hughes Aircraft Company, Los Angeles, Calif.

[21] Appl. No.: 415,004

[22] Filed: Sep. 29, 1989

[51] Int. Cl.[5] ..... H01R 13/54

[52] U.S. Cl. ..... 439/578

[58] Field of Search ..... 439/578–585

[56] References Cited

U.S. PATENT DOCUMENTS

| | | | |
|---|---|---|---|
| 3,673,546 | 6/1972 | Green et al. | 439/579 |
| 4,167,300 | 9/1979 | Fischer et al. | 439/578 |
| 4,426,127 | 1/1984 | Kubota | 439/578 |

*Primary Examiner*—Joseph H. McGlynn

*Attorney, Agent, or Firm*—Leonard A. Alkov; Wanda K. Denson-Low

[57] ABSTRACT

A self-aligning push-on coaxial RF connector assembly is disclosed. The male structure of the assembly includes a cross-slotted center conductor with a dielectric sleeve. The female structure of the assembly includes a feed-through device having a center conductor pin, a primary counterbored hole to the base of the feed-through, and a larger secondary pilot counterbored hole with a lead-in angle of about 15 degrees to the primary hole. The larger pilot hole allows for a substantial radial misalignment of the male and female structures. The center conductor pin is captured by the cross-slotted center conductor upon engagement. The dimensions of the assembly components are selected to provide a constant characteristic impedance throughout the connector assembly.

7 Claims, 2 Drawing Sheets

FIG. 1
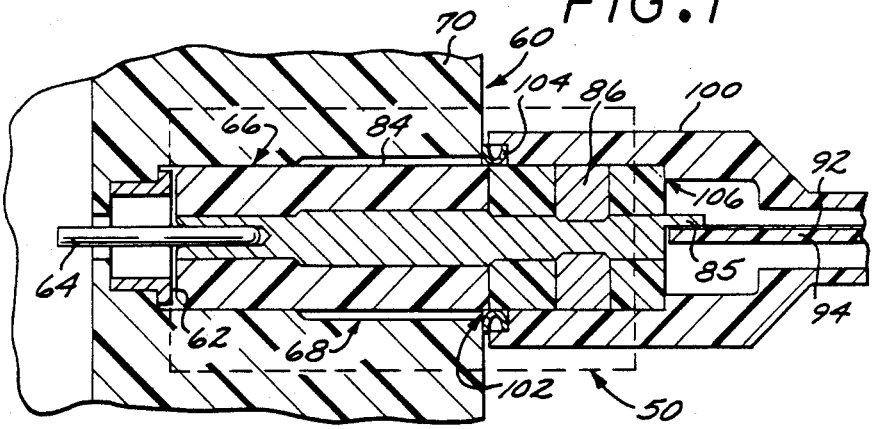
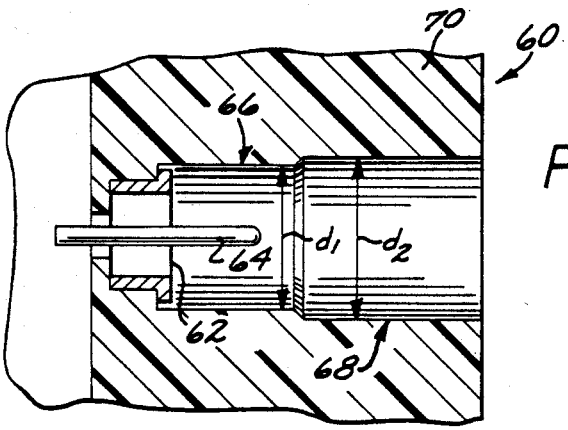
FIG. 2
FIG. 3
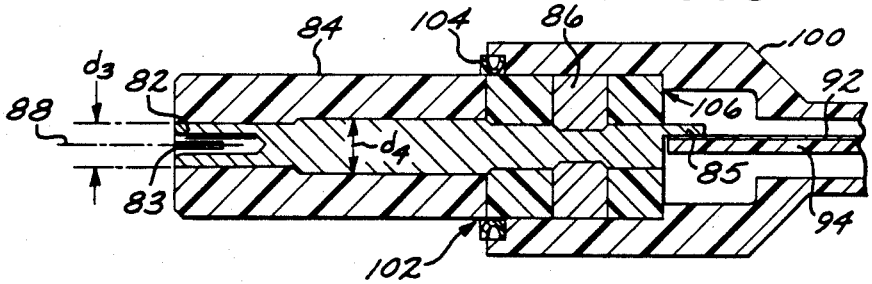

SELF-ALIGNING RF PUSH-ON CONNECTOR

BACKGROUND OF THE INVENTION

The present invention relates to the field of RF push-on connector that is self-aligning to the proper radial location during engagement.

Active array antenna systems provide the problem of how to simultaneously blind mount hundreds of RF connector interfaces between the transmit/receive modules and the radiating elements. The presently available push-on RF connectors do not provide sufficient tolerances to radial misalignments between the RF structures. Also, use of the presently available push-on connectors would require installation of the connector as a separate component into the transmit/receive module and the radiating element. This would create three RF interfaces.

It is therefore an object of the present invention to provide a push-on RF connector that is self-aligning and provides substantial tolerances to radial misalignments.

A further object is to provide a push-on RF connector which can be integrated into the microwave structures to be interfaces, thereby presenting only a single RF interface upon engagement.

SUMMARY OF THE INVENTION

A self-aligning push-on coaxial RF connector assembly is disclosed. The assembly comprises a female connector structure comprising a feed through conductor element supported by and extending through a dielectric member. The dielectric member is in turn supported by an outer conductor structure which defines a primary opening adjacent the dielectric member and conductor element. The outer structure further defines a pilot opening having a diameter somewhat larger than the diameter of the primary opening.

The assembly further comprises a male connector structure comprising a center conductor and a dielectric sleeve member having an axial opening formed therein for receiving the center conductor, the dielectric sleeve having an exterior dimension selected so that the sleeve can be inserted snugly into the primary opening of the female structure.

The assembly further comprises means for making electrical contact between the feed through conductor element of the female structure and the center conductor of the male structure when the sleeve and conductor are fully inserted into the primary opening. The oversized pilot opening serves to self-align the male structure with the primary opening and therefore allow for radial misalignment between the male and female structures. Means are further provided for compensating for the transmission line perturbation due to the oversizing of the pilot opening so that the transmission line provided by the connector assembly is characterized by a substantially constant characteristic impedance over the length of the assembly.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 1 is a cross-sectional view taken of an RF push-on connector assembly in accordance with the present invention.

FIG. 2 is a cross-sectional view of the female structure comprising the push-on connector assembly of FIG. 1.

FIG. 3 is a cross-sectional view of the male structure comprising the push-on connector assembly of FIG. 1.

DETAILED DESCRIPTION OF THE PREFERRED EMBODIMENT

Figure 4:
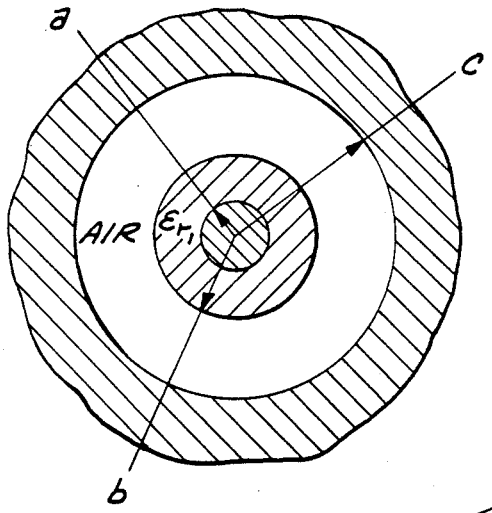
FIG. 4 is a cross-sectional view of a partially filled dielectric coaxial line.

As illustrated in FIGS. 1–3, a coaxial connector assembly 50 embodying the invention comprises a female structure 60 (FIG. 2) and a male structure 80 (FIG. 3). The male structure comprises a beryllium copper center conductor 82 in a teflon sleeve 84. An epoxy dielectric plug 86 is embedded in the teflon sleeve 84, and captures the center conductor 82 to prevent slippage of the conductor 82 along the axis 88 of the structure 80 as the male and female structures are brought together.

In the embodiment of FIGS. 1–3, the male structure 80 is in turn secured to an airline transmission line circuit comprising an airline conductor 92 formed on an airline dielectric board 94. A structure 100 formed of a conductive material snugly receives the male structure 80 within an aperture 102. A conductive compliance gasket 104 pliantly contacts the sleeve 84 and ensures good electrical contact with the ground of the female structure 60. A stop shoulder 106 is defined by the structure 100, the male structure 80 sliding within aperture 102 until the teflon sleeve 84 abuts against the stop shoulder 106. A cantilevered tab 85 extends from the interior end of the conductor 82, and makes electric contact with the airline conductor 92, e.g., via a solder connection.

The connection of the male structure 80 to an airline circuit is to be considered only one exemplary type of application of the invention, particularly well suited to the application of making connections to phased array radiating elements.

The female structure 60 comprises a RF hermetic feed through 62 with a kolvar center conductor 64 fitted into a conductive outer structure 70. The structure 60 further comprises a primary counterbored hole 66 to the base of the feed through 62, and a secondary pilot counterbored hole 68 with a lead-in angle of about 15°. to the primary hole 66. The larger pilot hole 68 allows for ±10 mils or greater radial misalignment of the two structures 60 and 80. The lead-in angle will properly position the male structure 80 upon insertion of the teflon sleeve 84 by deflecting the beryllium copper conductor 82 and teflon sleeve 84. The primary hole 66 provides a snug fit to the teflon sleeve 82 of the male structure 80 and thus relieves any stress that might be transferred to the hermetic feed through 64. The end 83 of the beryllium copper center conductor 82 is cross-slotted in order to capture the kolvar center pin 64 upon engagement.

From an RF perspective, the transmission line in the pilot hole 68 is described as a partially filled dielectric coaxial line as shown in FIG. 4. The characteristic impedance and effective dielectric constant of such a transmission line are given by eqs. 1 and 2.

$$Z_o = (377/2\pi)\left[\left(\ln\left(\frac{c}{a}\right)\right)\left(\left(\ln\left(\frac{b}{a}\right)/e_{r1}\right)+\ln\left(\frac{c}{b}\right)\right]^{\frac{1}{2}} \quad (1)$$

$$E_r(\text{effective}) = \left[\left(\ln\frac{b}{a}\right)/\left(e_{r1}\ln\left(\frac{c}{a}\right)\right)+\left(\ln\left(\frac{c}{b}\right)/\ln\left(\frac{c}{a}\right)\right]\right. \quad (2)$$

where $E_{r1}$=dielectric constant of the dielectric, a= radius of the center conductor, b radius of center conductor and dielectric, and c= radius of the coaxial line.

From eqs. 1 and 2, the proper dimensions of the beryllium copper center conductor are determined so that the characteristic impedance is equal to 50 ohms throughout the connectors.

The length of the pilot hole 68 is made to equal a quarter-wavelength at the center frequency of the band of interest. This length is selected so that the capacitances due to the discontinuities will cancel out. Moreover, the center conductor 82 of the male structure 80 is oversized by about 10 mils along an oversized region which is coextensive which the pilot hole 68 when the structures 70 and 80 are brought together. The oversizing of the center conductor 82 compensates for the oversizing of the pilot hole 68. Thus, for one application, the diameter $d_1$ of the primary hole 66 is .162 inch, the diameter $d_2$ of the pilot hole 68 is $d_1$ +.020 inch or .182 inch, the diameter $d_3$ of the center conductor 82 is .050 inch, except that the diameter $d_4$ of the oversized region of the center conductor is $d_3$ +.010 inch or .060 inch. The length of the quarter-wavelength pilot hole 68 in this application is .200 inch. A connector assembly having these dimensions provides an excellent match across a wide band from about 60 MHz to 25 GHz. Moreover, there is no degradation in RF performance when radial load is applied to the connector assembly causing the center conductor to bend.

Figure 5:
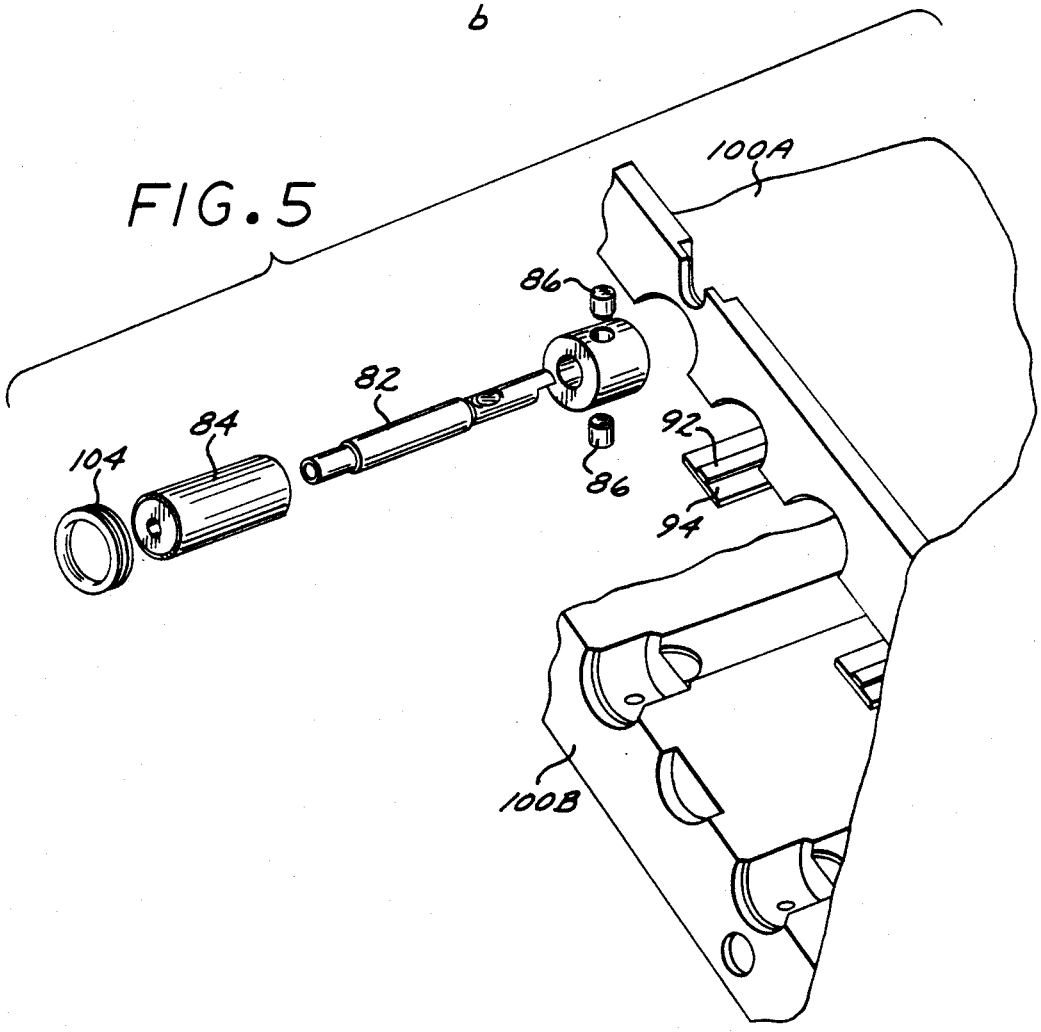
FIG. 5 is an exploded perspective view showing, in a typical application, the male structure of the connector assembly integrated with the radiating element structure for an active array system.

FIG. 5 shows how easily this connector assembly can be integrated with a radiating element in an array system. The structure 100 in this application is defined by upper and lower structure members 100A and 100B, which accepts a plurality of male structures 80, and connects the respective center conductors 82 to corresponding airstripline conductors 92 which in turn connect to the system radiating elements.

It is understood that the above-described embodiment is merely illustrative of the possible specific embodiments which may represent principles of the present invention. Other arrangements may readily be devised in accordance with these principles by those skilled in the art without departing from the scope of the invention.

What is claimed is:

1. A self-aligning push-on coaxial RF connector assembly, comprising:

a female connector structure comprising a feed through conductor element supported by and extending through a dielectric member, an outer conductive structure for defining a primary opening surrounding said dielectric member and conductor element and for defining a pilot opening having a diameter somewhat larger than the diameter of said primary opening, the pilot opening communicating with the primary opening;

a male connector structure comprising a center conductor, a dielectric sleeve member having an axial opening formed therein for receiving the center conductor, the dielectric sleeve having an exterior dimension selected so that a portion of the sleeve can be inserted snugly into the primary opening of said female structure;

means for making electrical contact between the feed through conductor element of the female structure and the center conductor of the male structure when the sleeve and conductor are fully inserted into said primary opening; and means for compensating the perturbation due to the oversizing of the pilot opening so that the transmission line provided by the connector assembly is characterized by a substantially constant characteristic impedance over the length of the assembly.

2. The connector assembly of claim 1 wherein said outer conductive structure is tapered between said pilot and primary openings to define a lead-in angle between said pilot opening and primary opening to facilitate insertion of said dielectric sleeve into said primary opening.

3. The connector assembly of claim 2 wherein said lead-in angle is about 15°.

4. The connector assembly of claim 1 wherein said means for compensating comprises a region of said center conductor of said male structure having an enlarged diameter, the length of said region being substantially equal to the length of said pilot hole, and wherein said region is positioned along the axis of the center conductor to be coextensive with said pilot opening when the male structure is fully inserted in said female structure, said enlarged diameter being selected so that the coaxial transmission line defined by said connector assembly is characterized by a substantially constant characteristic impedance over the length of the assembly.

5. The connector assembly of claim 4 wherein the length of said pilot opening is about one-quarter wavelength at the center frequency of the frequency band of operation, whereby capacitances due to transmission line discontinuities created by the differences in the diameters of the primary and pilot holes are substantially cancelled out.

6. The connector assembly of claim 1 wherein the center conductor of said male structure is in turn electrically connected to the conductor of an airline transmission line.

7. A self-aligning push-on coaxial RF connector assembly, comprising:

a female connector structure comprising a feed through conductor element supported by and extending through a dielectric member, an outer conductive structure for defining a primary opening surrounding said dielectric member and conductor element and for defining a pilot opening having a diameter somewhat larger than the diameter of said primary opening, the pilot opening communicating with the primary opening;

the length of said pilot opening selected to be substantially one-quarter wavelength at the center frequency of the frequency band of interest;

a male connector structure comprising a center conductor, a dielectric sleeve member having an axial opening formed therein for receiving the center conductor, the dielectric sleeve having an exterior dimension selected so that a portion of the sleeve can be inserted snugly into the primary opening of said female structure;

said outer conductive structure of said female connector structure being tapered between said pilot and primary openings to define a lead-in angle between said pilot opening and primary opening to facilitate insertion of said dielectric sleeve member into said primary opening;

means for making electrical contact between the feed through conductor element of the female structure and the center conductor of the male structure when the sleeve and conductor are fully inserted into said primary opening; and means for compensating the perturbation due to the oversizing of the pilot opening so that the transmission line provided by the connector assembly is characterized by a substantially constant characteristic impedance over the length of the assembly, said means comprising a region of said center conductor of said male structure having an enlarged diameter, the length of said region being substantially equal to the length of said pilot hole, and wherein said region is positioned along the axis of the center conductor to be coextensive with said pilot opening when the male structure is fully inserted in said female structure, said enlarged diameter being selected so that the coaxial transmission line defined by said connector assembly is characterized by a substantially constant characteristic impedance over the length of the assembly.

* * * * *

UNITED STATES PATENT AND TRADEMARK OFFICE

CERTIFICATE OF CORRECTION

PATENT NO. : 4,957,456

DATED : September 8, 1990

INVENTOR(S) : Mark Olson et al.

It is certified that error appears in the above-identified patent and that said Letters Patent is hereby corrected as shown below:

Column 1, line 3, after the title and before the heading "BACKGROUND OF THE INVENTION," insert the paragraph: --This invention was made with Government support under Contract No. G-6130-FCOM awarded by the Government. The Government has certain rights in this invention.--

Column 3, line 16, after "b" and before the second occurence of "radius" insert an equal sign -- = -- therefor.

Signed and Sealed this

Twenty-seventh Day of December, 1994

*Attest:*

Bruce Lehman

BRUCE LEHMAN

*Attesting Officer*

*Commissioner of Patents and Trademarks*